US007814627B2

(12) United States Patent
Massotte et al.

(10) Patent No.: US 7,814,627 B2
(45) Date of Patent: Oct. 19, 2010

(54) PROCESS FOR TREATING THREADS BY KNITTING-UNRAVELING

(75) Inventors: Philippe Massotte, Gueberschwihr (FR); Didier Thibault, Bru (FR); Hubert Liebmann, Wittelsheim (FR)

(73) Assignee: Superba, Mulhouse (FR)

( * ) Notice: Subject to any disclaimer, the term of this patent is extended or adjusted under 35 U.S.C. 154(b) by 403 days.

(21) Appl. No.: 11/928,526

(22) Filed: Oct. 30, 2007

(65) Prior Publication Data

US 2008/0098581 A1 May 1, 2008

Related U.S. Application Data

(60) Provisional application No. 60/861,099, filed on Nov. 27, 2006.

(30) Foreign Application Priority Data

Oct. 30, 2006 (FR) ..... 06 54631
Jul. 16, 2007 (FR) ..... 07 05136

(51) Int. Cl.
*D04B 19/00* (2006.01)

(52) U.S. Cl. ..... 28/218; 28/171

(58) Field of Classification Search ..... 28/218, 28/171, 219, 220, 247, 165, 248, 251, 166, 28/172.1, 258; 66/1 R, 149 R, 151, 152; 57/205, 208, 246

See application file for complete search history.

(56) References Cited

U.S. PATENT DOCUMENTS 772,458 A * 10/1904 Curtis ..... 28/171
1,176,776 A * 3/1916 Mueller ..... 28/171
1,399,657 A * 12/1921 Robischon ..... 28/171
2,061,233 A * 11/1936 Gustav ..... 28/171
3,466,718 A * 9/1969 Adamson ..... 28/166
3,568,278 A * 3/1971 Mattingly ..... 28/218
3,579,764 A * 5/1971 Kieffer ..... 28/218
3,720,984 A * 3/1973 Roberson, Jr. ..... 28/218
3,919,749 A * 11/1975 McWhirter et al. ..... 28/218
4,530,137 A * 7/1985 Moss et al. ..... 28/171
4,870,839 A * 10/1989 Odham ..... 66/125 A
5,113,564 A * 5/1992 Suzuki ..... 28/218
6,321,427 B1 11/2001 Auguste et al.
6,694,582 B1 * 2/2004 Agrikli ..... 28/171

FOREIGN PATENT DOCUMENTS

FR 2 430 997 2/1980

* cited by examiner

*Primary Examiner*—Amy B Vanatta
(74) *Attorney, Agent, or Firm*—Young & Thompson

(57) ABSTRACT

Process for treating threads by knitting-unraveling includes: knitting several individual threads (2) on a multi-feed knitting machine (1); carrying out one or more heat, chemical or other treatments, in one or more chambers (7); carrying out, in an unraveling unit (4), an unraveling with pulling on the first knit thread and winding or beaming the unraveled threads (2) individually or carrying out on these individual threads another treatment operation or a production operation, optionally with an intermediate accumulation of the threads. The invention can be applied more particularly in the field of the textile industry, in particular the treatment of threads, particularly texturing by knitting-unraveling.

21 Claims, 10 Drawing Sheets

PROCESS FOR TREATING THREADS BY KNITTING-UNRAVELING

This invention relates to the field of the textile industry, in particular the treatment of threads, particularly texturing by knitting-unraveling, and it has as its object a process for treating threads by knitting-unraveling.

The invention also has as its object a thread treatment line for implementing the process.

The knitting-unraveling process is known in the art and is designed for the production of textured threads that come on spools or on beams for the purpose of later use.

For this purpose, a knitting-unraveling process in which several threads are knitted and unraveled together is known more particularly by U.S. Pat. No. 3,720,984. These threads are delivered by stationary spools to a single-feed multi-thread knitting machine by means of a single thread guide, and the needles of said knitting machine each take up all of the threads to knit them into a stationary knitted fabric, i.e., to knit a bundle of threads into a tube or stationary knitted fabric. Then, this stationary knitted fabric is subjected to a heat-setting treatment or the like and, at the outlet of this treatment, it is unraveled, and the various textured constituent threads following the heat treatment or the like are wound separately on individual spools.

This process has, however, the drawback of producing multi-thread meshes, i.e., having several threads in a single mesh and in a single row. Furthermore, it also has the drawback of not allowing a knitting of large threads because of the limitation dictated, on the one hand, by the diameter of the single thread guide and, on the other hand, by the dimensions of the needles. Finally, the very fact of knitting an array of threads in the form of multi-thread stitches creates the possibility that, during deknitting, there may be problems in undoing the stitches by pulling the threads, whereby one or more threads may offer resistance to more significant pulling during said deknitting, such that a tangling of the individual threads, causing their breakage, can occur.

U.S. Pat. No. 6,321,427 describes a knitting process of a large single thread by means of a tubular knitting machine, in which the thread rotates above the needles of the knitting machine. In this process, the sock or knitted fabric that is obtained is stored in a pot and then undergoes a treatment, and then is deknitted. The process according to this document has the drawback of treating only a single thread at one time and of being discontinuous, i.e., it requires that the knitted fabric be taken up for deknitting.

This invention has as its object to overcome the drawbacks of the processes that are known to date by proposing a process for treating threads by knitting-deknitting, allowing a simultaneous treatment of several threads without limitation due to their thickness and an easier deknitting, without the risk of tangling the pulled threads.

According to the invention, this process is characterized in that it consists in knitting several individual threads on a multi-feed knitting machine, then in carrying out one or more heat, chemical, or other treatments, then in carrying out an deknitting with pulling on the first knit thread and in winding or in beaming the deknitted threads individually or in carrying out on these individual threads another treatment operation or a production operation, optionally with an intermediate accumulation of said threads.

The invention also has as its object a thread treatment line for implementing this process, characterized in that it comprises a multi-feed knitting machine supplied by threads by means of spools, an deknitting unit that supplies a winder, optionally with an interposed accumulator, whereby one or more heat, chemical or other treatment chambers are provided between the knitting machine and the deknitting unit.

The invention will be better understood thanks to the description below, which relates to preferred embodiments, provided by way of nonlimiting examples and explained with reference to the attached diagrammatic drawings, in which.

Figure 1:
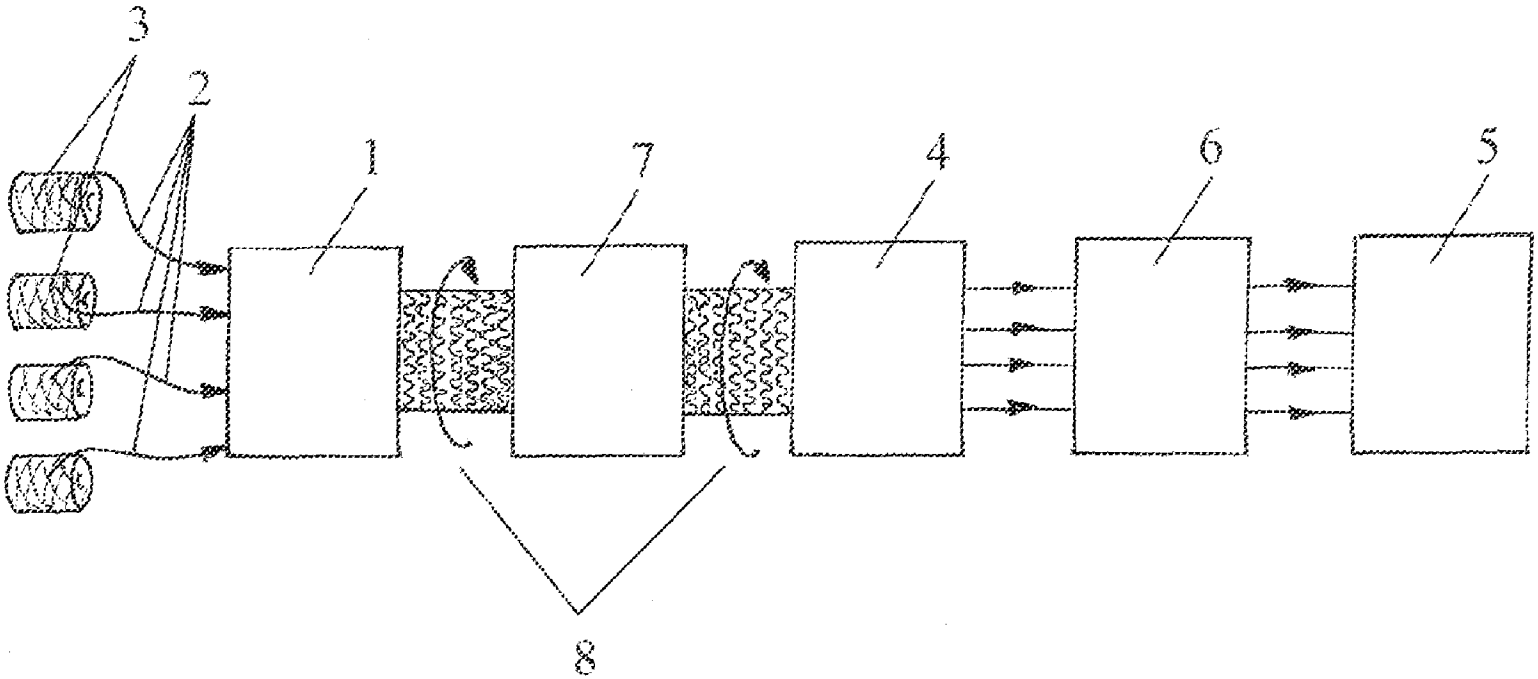
FIG. 1 is a diagrammatic top view of a treatment line that implements the process according to this invention.
Figure 6:
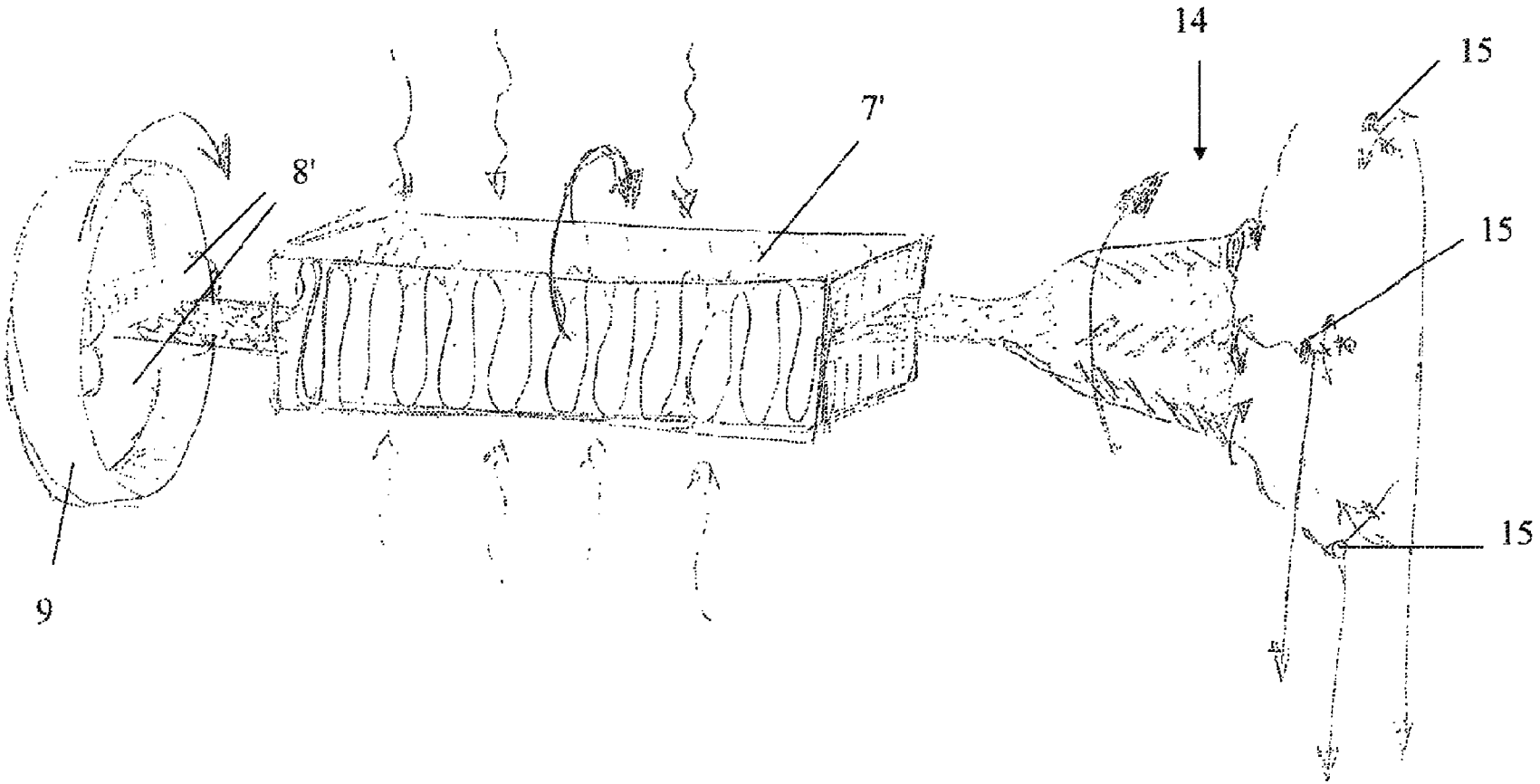
FIG. 6 is a view that is analogous to that of FIG. 1 of a variant embodiment of the treatment line.

FIGS. 1 and 6 of the accompanying drawings diagrammatically show a thread treatment line that comprises a multi-feed knitting machine 1 that is supplied with thread 2 by means of spools 3, an deknitting unit 4 that supplies a winder 5, optionally with an interposed accumulator 6, whereby one or more heat, chemical or other treatment chambers 7, 7' are provided between the knitting machine 1 and the deknitting unit 4 (FIG. 1).

According to the invention, these thread treatment lines implement a process that consists in knitting several individual threads 2 on the multi-feed knitting machine 1, then in carrying out one or more heat, chemical or other treatments in one or more chambers 7, 7'. At the outlet of the latter, an deknitting with pulling on the first knit thread is then carried out, and the deknitted threads are then wound on the winder 5 or beamed individually. It is also possible to carry out on these deknitted threads another treatment operation or directly a production operation, after their intermediate accumulation.

Figure 2:
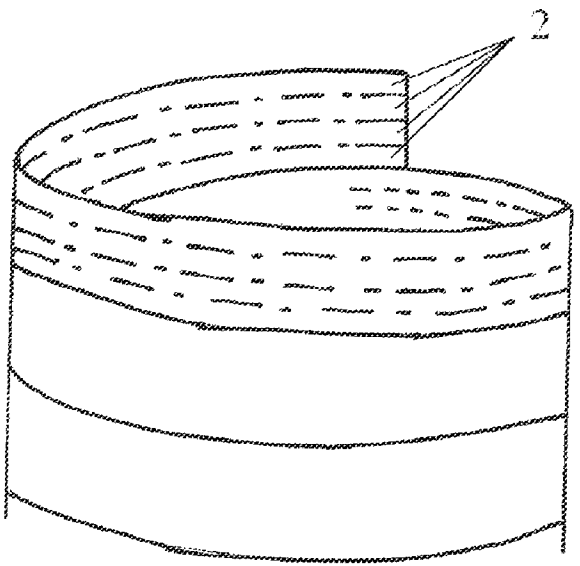
FIG. 2 is a partial perspective view of a knitted fabric that is made on a multi-feed knitting machine.

According to a characteristic of the invention, each thread 1 is guided in an individual thread guide and is knit individually with the other threads on the multi-feed knitting machine 1 to produce a multi-thread knitted fabric with superposed one-thread stitches. Such a multi-thread knitted fabric is shown in FIG. 2 of the accompanying drawings and has one-thread stitches superposed in spirals, which are made in several rows of several stitches of individual threads 2.

In the embodiment that is described above, the knitted fabric that is obtained is directly transported through the treatment chamber 7, and then is deknitted for the purpose of individual winding of the threads on the winder 5. In such a case, as the knitting is carried out in a multi-feed knitting machine, i.e., on a machine whose device for supplying individual threads is stationary and whose knitting needles are mounted on a rotating drum, the knitted fabric that exits from the knitting machine 1 is driven by a rotary movement tending to twist it, such that the subsequent continuous treatment would not be possible.

Figure 4:
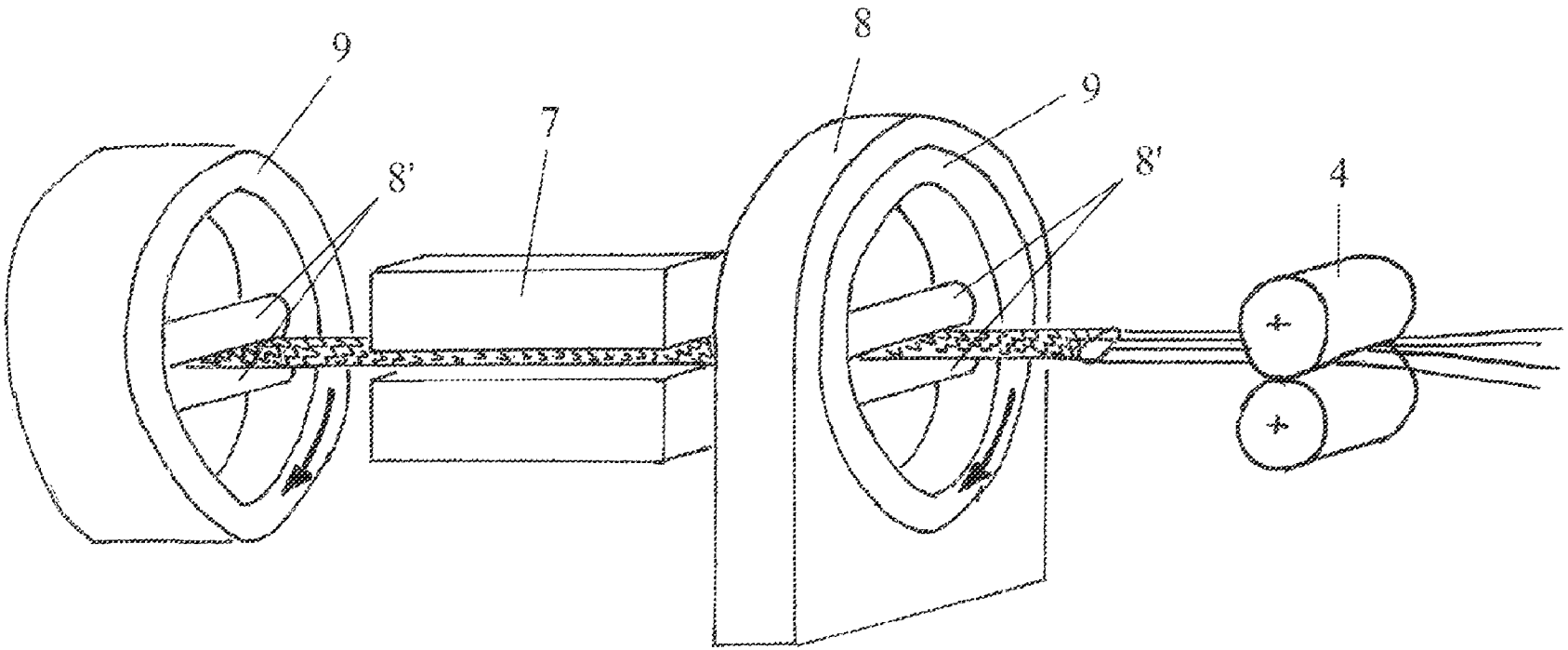
FIG. 4 is a partial perspective view that shows the treatment zone between the knitting and the deknitting.
Figure 5:
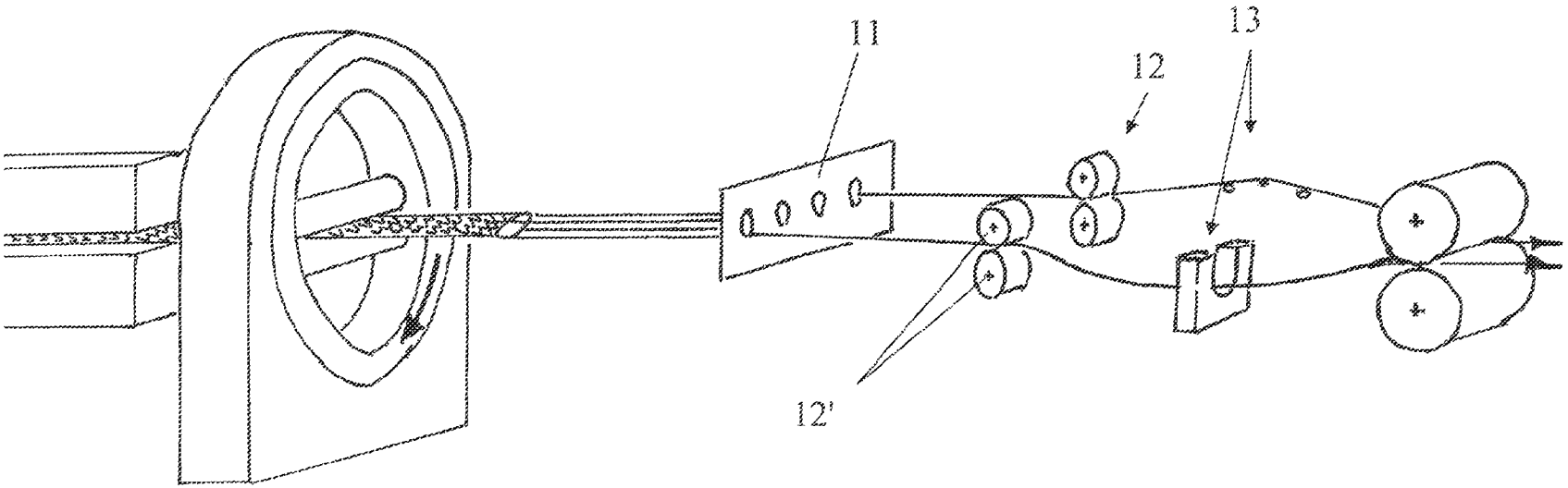
FIG. 5 is a view that is analogous to that of FIG. 4 that shows an deknitting zone.

To prevent this drawback, it is provided, according to another characteristic of the invention, to guide and to drive the knitted fabric in rotation and in movement along its longitudinal axis, between the outlet of the knitting machine 1 and the deknitting unit 4 by means of a rotary drive device 8, around its longitudinal axis (FIGS. 4 and 5). Thus, the rotation of the knitted fabric at the outlet of the multi-feed knitting machine 1 is fully compensated for by the drive device 8, such that any twisting of the knitted fabric is avoided, as much during its passage into the treatment chamber 7, 7' as in the deknitting unit 4. It follows that at the outlet of the drive device 8, the end of the knitted fabric during deknitting can follow exactly the passage of the threads that are deknitted, preventing the latter from tangling and thus running the risk of being broken, which would have the result of preventing a continuous operation. The positioning of the drive device 8 is indicated in FIG. 1 by the two arrows that are shown, on the one hand, between the knitting machine 1 and the treatment chamber 7, 7' and, on the other hand, between said chamber 7, 7' and the deknitting unit 4.

Preferably, the drive device 8 comes in the form of two pairs of traction cylinders 8', extending perpendicular to the direction of forward motion and to the longitudinal axis of the knitted fabric that exits from the multi-feed knitting machine 1 and each mounted in a rotary bearing 9 around the longitudinal axis of the knitted fabric, whereby the support bearings 9 of the traction cylinders 8' are synchronized in rotation between them and with the drum of the multi-feed knitting machine 1.

According to another characteristic of the invention, the knitted fabric that is obtained can advantageously be subjected to accumulation before deknitting in the treatment chamber 7, 7'.

Such an accumulation is not shown in the embodiment according to FIGS. 1, 4, 5, 10 and 11, but can be carried out by means of an accumulation device that comprises, for example, superposed meshed belts 20 for accommodating and for driving the knitted fabric at a linear speed that is variable but at most equal to the linear speed of knitting, whereby these belts are mounted on a common chassis driven in rotation around its longitudinal axis, in synchronism with the drive device 8 and arranged between the traction cylinders 8' of said drive device 8, in the treatment chamber 7, 7'.

It is also possible, according to another variant embodiment of the invention, not shown in the accompanying drawings, to use an accumulation device with return rollers 21 that are arranged between the traction cylinders 8' of the drive device 8, in the treatment chamber 7, 7' and mounted on a chassis that is driven in rotation in synchronism with said drive device 8. The knitted fabric accumulation in the chamber 7, 7' makes it possible to optimize the treatment of the latter as well as to prevent excess tension on the latter, tension that could result in an undesired permanent deformation of the threads after deknitting.

In the embodiment of the treatment line according to FIGS. 1, 4 and 5, said line extends horizontally, and the entire operation is carried out following a horizontal forward motion. However, it is also possible to carry out all the treatment operations along a vertical axis. According to one characteristic of the invention, the knitted fabric that is driven by the traction cylinder 8' of the drive device 8, at the outlet of the multi-feed knitting machine 1, is then accumulated in the treatment chamber 7' by gravity.

For this purpose, according to a variant embodiment of the invention shown in FIG. 6 of the accompanying drawings, the treatment line is arranged vertically, and the treatment chamber 7' is vertical and simultaneously forms a means for accumulation by gravity supplied by the traction cylinder 8' of the drive device 8, whereby the deknitting unit 4 is directly connected to the lower part of the treatment chamber 7'.

Figure 3:
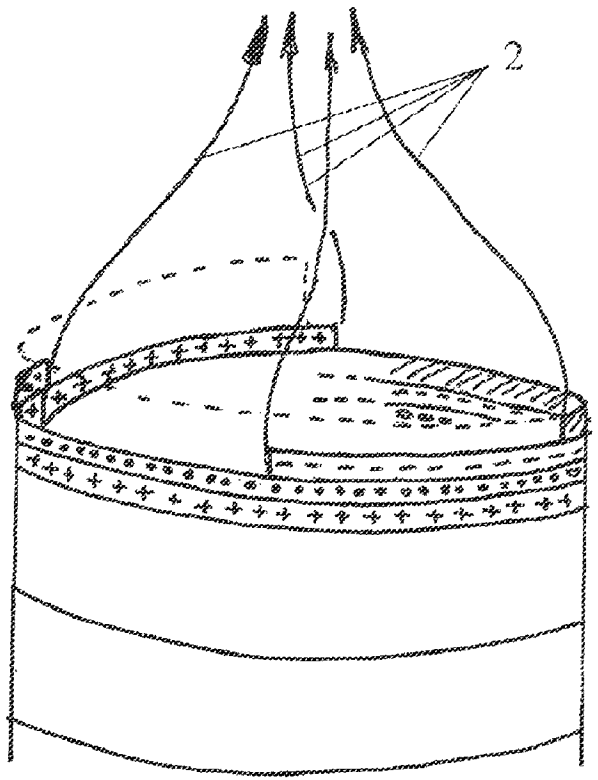
FIG. 3 is a view that is analogous to that of FIG. 2, showing an deknitting of a knitted fabric that is made on a multi-feed knitting machine.

Because of the continuous treatment of the knitted fabric, the deknitting by pulling on the threads is done directly on said threads exactly following the same order of succession as that of the knitting, i.e., the first knit thread becomes the first deknitted thread, such that, as FIGS. 3, 5 and 6 show, the threads 1 ideally can be deknitted without the risk that the thread of the lower layer will pass under the thread of the upper layer and impede the deknitting, whereby the knitted fabric is, furthermore, continually driven in rotation in the direction that is indicated so as to maintain a parallel path of the threads after the deknitting.

At the outlet of the deknitting unit 4, the threads 2 are wound individually on the winder 5 or undergo an additional chemical, heat or other treatment or enter a transformation station, optionally after passage into an accumulator 6 (FIG. 1).

According to a first embodiment of the invention, shown more particularly in FIG. 5 of the accompanying drawings, the deknitting unit 4 comprises a comb or a plate with holes 11 for individually guiding the threads and a thread pulling means 12. Thus, the deknitting of the threads 2 can be carried out in a virtually identical manner to their knitting. The threads 2 are wound on the winder 5 virtually without tension, whereby the winder 5 is advantageously equipped, in a known manner, with a tension-regulating means.

In this embodiment, the deknitting unit 4 advantageously has a thread pulling means 12 that comprises a large number of pairs of individual drive rollers 12' for each thread 2, whereby each pair of rollers 12' is regulated individually by means of an optical, mechanical or other detection device 13, monitoring any tension variation of the threads 2. Thus, a variation in length of the thread between the means 12 and the inlet of the winder 5 will manifest itself as slack or a more or less strong tension of the thread, and the device 13 will automatically deliver a correction signal that corresponds to the pair of rollers 12' for pulling this thread.

Figure 7:
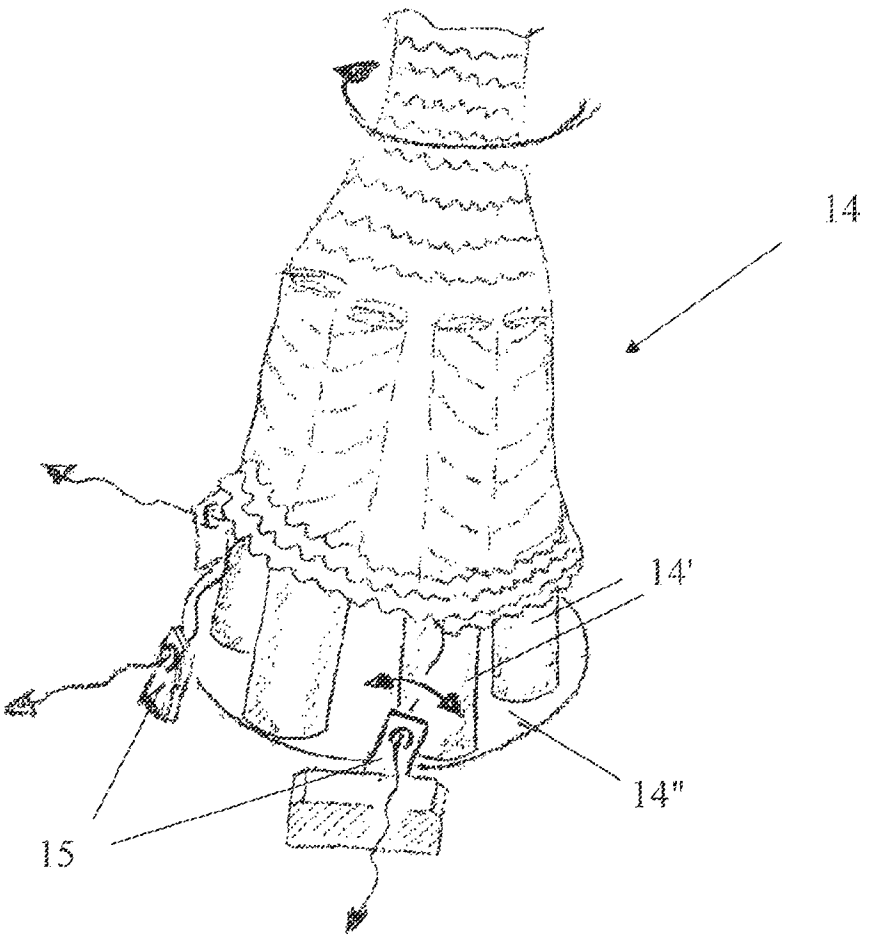
FIG. 7 is a partial perspective view of the deknitting zone of the treatment line according to FIG. 6.

According to another variant embodiment of the invention, and as FIGS. 6 and 7 of the accompanying drawings show, the deknitting unit 4 can consist of a means 14 for pulling and reshaping the knitted fabric along its approximate initial section and by individual deknitting eyelets 15 that are arranged upstream from the thread pulling means 12. Such a means 14 is designed to take up the knitted fabric directly at the outlet of the treatment chamber 7, 7', without an interposed traction cylinder 8' of the drive device 8.

Figure 8:
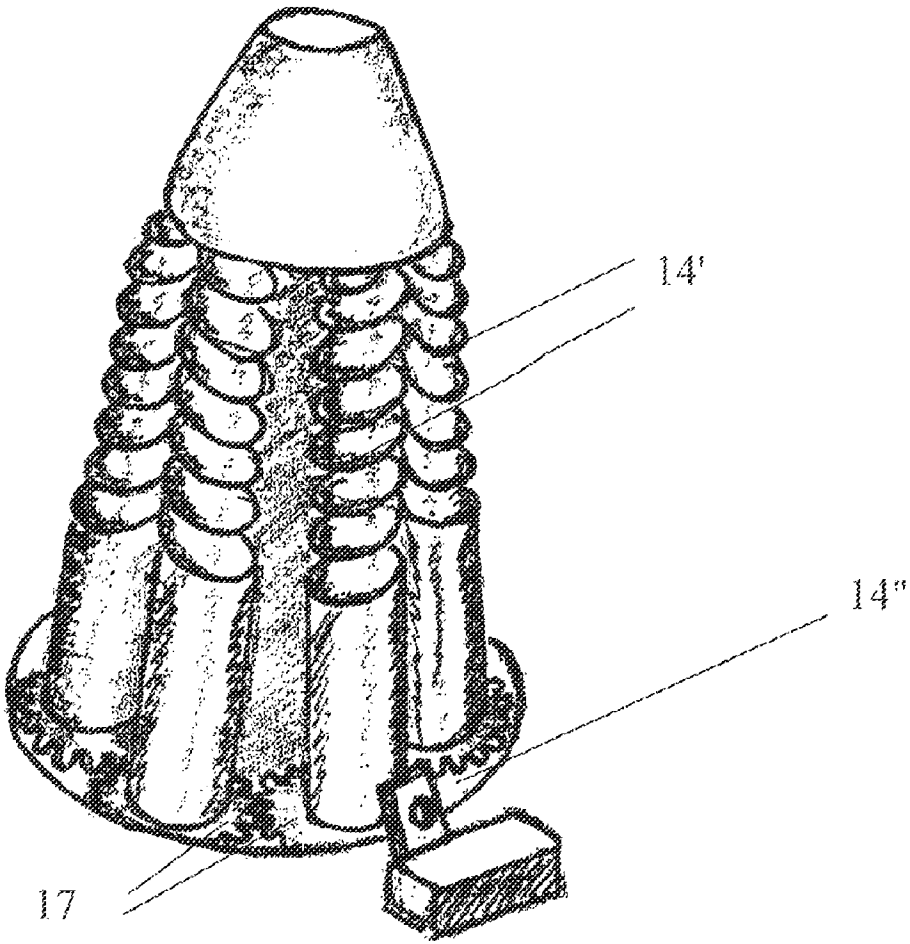
FIG. 8 is a perspective view of the means of pulling and reshaping the knitted fabric according to FIG. 7.
Figure 9:
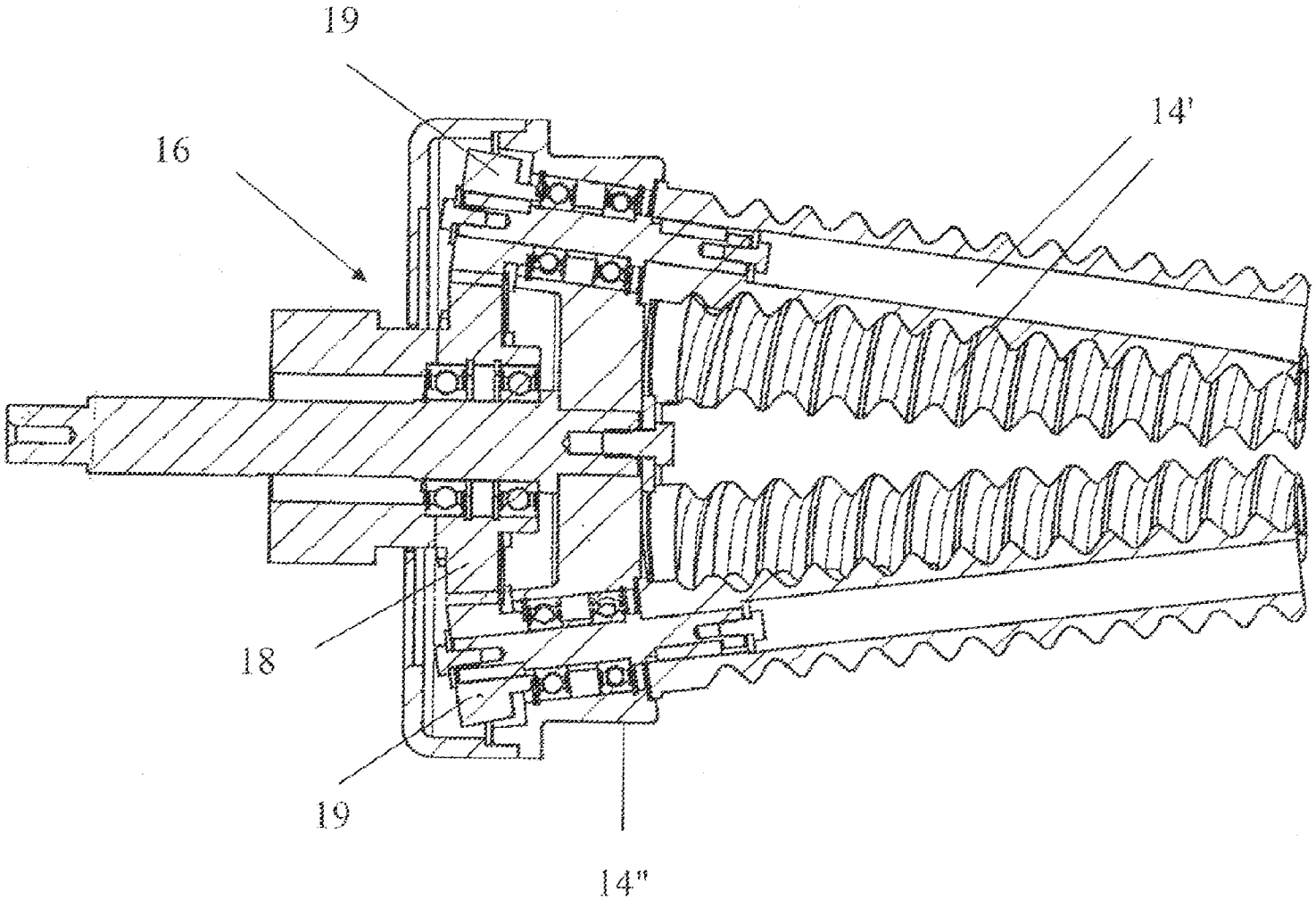
FIG. 9 is a longitudinal cutaway view of the pulling means according to FIG. 8.
Figure 10:
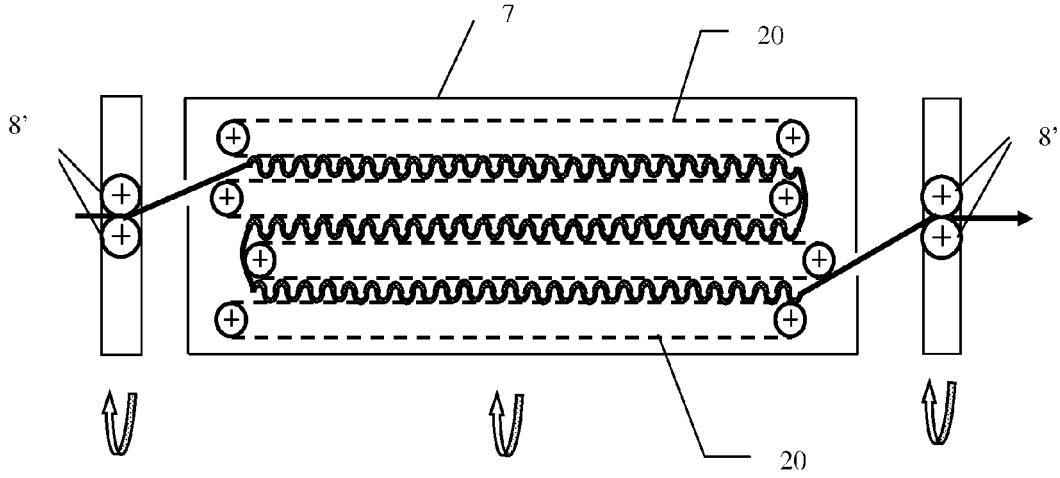
FIG. 10 is a perspective view that shows the superposed meshed belts in the treatment chamber.
Figure 11:
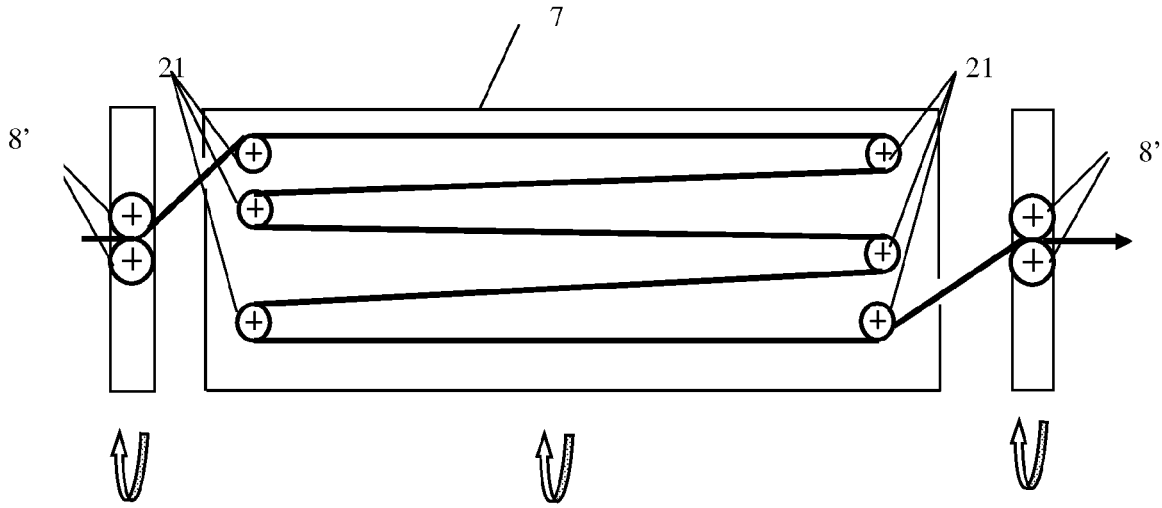
FIG. 11 is a perspective view that shows the return rollers in the treatment chamber.

For this purpose, the means 14 for pulling and reshaping the knitted fabric along its approximate initial section consists of an even number of trainers 14' in the form of conical screws, arranged in the shape of a truncated cone on a rotary support 14" and half driven by a differential drive 16 (FIGS. 8 and 9). The conical screws that form the trainers 14' have a smooth lower zone, close to the rotary support 14", and they are alternately equipped with right-handed threading and left-handed threading, whereby two screws with opposite threads are connected to one another by a pair of drive gears 17 and whereby one of the screws that forms a trainer 14' with a pair of trainers 14' is in a drive connection with a drive gear 18 of differential drive 16, by means of a drive gear 19. The drive by pair of trainers 14' in the form of conical screws makes it possible to ensure that the knitted fabric that is taken up by the means 14 is duly driven toward the end of the latter and toward the individual deknitting eyelets 15, and their smooth lower zone precludes any chance of unstitching and promotes deknitting.

This means 14 is shown in combination with a vertical treatment chamber 7' with a vertical treatment line equipped with a means of accumulation by gravity. It is also possible, however, to use this means 14 with a horizontal treatment line, such as the one according to FIG. 1, with a treatment chamber 7.

Such a production of the means 14 for pulling and reshaping the knitted fabric along its approximate initial section makes possible, on the one hand, an easier take-up of the knitted fabric at the outlet of the chamber 7, and, on the other hand, an expansion of the latter with a section that is close to that of knitting, such that deknitting is made easier.

The means 14 for pulling and reshaping the knitted fabric along its approximate initial section is driven in rotation at the speed of rotation of knitting, in synchronism with the multi-feed knitting machine 1, by means of a drive gear (not shown) that is integral in rotation with the rotary support 14", and the trainers 14' in the form of conical screws engage with the drive gear 18 of the differential drive 16. The drive of the drive gear 18 with a speed that is different from that of the drive of the rotary support 14" makes it possible to influence the speed of rotation of the trainers 14' and thus, by increase or by reduction of the latter, to pull, more or less quickly, the end of the knitted fabric to be deknitted toward the support 14" and therefore to position the latter relative to the deknitting eyelets 15.

In addition, according to another characteristic of the invention, not shown in the accompanying drawings, the means 14 can be equipped with at least one position sensor of the end of the knitted fabric during deknitting, as well as position sensors of deknitting, which are connected, respectively, to an electronic control means of the differential drive 16 and to the thread pulling means 12. These sensors are designed, respectively: the first to detect an optimum position of the end of the knitted fabric during deknitting, and the others to detect an optimum position of each thread to be deknitted relative to the corresponding deknitting eyelet 15. The operation of such position sensors and electronic control circuits to which they are connected is known to one skilled in the art and does not require an additional description.

The position sensors can preferably be of the detection-by-zone type, making it possible to detect the end of the knitted fabric to be deknitted or a thread during deknitting, for example by verification of a positioning at a predetermined location of the zone, and they deliver signals for acceleration or deceleration of the speed of rotation of the differential drive 16 and/or of the pairs of individual drive rollers 12' of each thread 2 of thread pulling means 12.

Thus, it is possible to position continuously the end of the knitted fabric to be deknitted in an optimum way during the entire deknitting operation.

According to a variant embodiment of the invention, not shown in the accompanying drawings, the thread treatment process can also be interrupted by provision of an intermediate storage stage. In such a case, the process is carried out by means of a stationary knitting machine, in which the threads are brought into rotation individually above the machine by rotation of the spools with their support, then the knitted fabric that is produced by the stationary machine is taken to the outlet of the latter by guide cylinders and transported into one or more heat, chemical or other treatment chambers, whereby the knitted fabric is deposited at the outlet of this chamber or these chambers in a pot or on a spool and cut after the pot or the spool is filled, and then stored.

After storage, the knitted fabric is taken up in the pot or on the spool for deknitting from the last knit thread, whereby the pot is mounted on a support in a rotary manner around its vertical axis or whereby the spool is mounted on a rotary spool support around an axis that is perpendicular to the axis of the spool, whereby the deknitted threads are then wound or beamed or subjected to another treatment or transformation operation. This deknitting can, of course, be carried out by means of a unit that is comparable to the deknitting unit 4 that is described above.

In this embodiment, the knitted fabric can be treated in a closed chamber, for example for a pressurized heat setting.

Thanks to the invention, it is possible to carry out texturing of a large number of threads by knitting-deknitting and heat, chemical or other treatments of these threads. Whereby this texturing is done continuously or quasi-continuously, the invention allows a very high increase in production while ensuring a safe operation, in particular during the deknitting operation.

Of course, the invention is not limited to the embodiments that are described and shown in the accompanying drawings. Modifications remain possible, in particular from the standpoint of the constitution of the various elements or by substitution of equivalent techniques, without thereby exceeding the field of protection of the invention.

The invention claimed is:

1. A method for treating threads by knitting-unraveling, comprising:

knitting a plurality of individual threads (2) on a multi-feed knitting machine (1);

treating a fabric produced by the knitting by one or more heat, chemical or other treatments, in one or more chambers (7, 7');

accumulating the fabric produced from the knitting prior to unraveling; and unraveling the fabric in an unraveling unit (4), by pulling on a first knit thread and winding or beaming the unraveled threads (2) individually.

2. The method according to claim 1, wherein each thread (1) is guided in an individual thread guide and is knit individually with the other threads on the multi-feed knitting machine (1) to carry out a multi-thread knitting with one-thread meshes that are superposed in spirals, which are produced in a plurality of rows of a plurality of meshes of individual threads (2).

3. The method according to claim 1, wherein the knitted fabric is guided and driven in rotation and in movement along the knitted fabric's longitudinal axis, between the outlet of the knitting machine (1) and the unraveling unit (4) using a drive device (8) that rotates around a longitudinal axis.

4. The method according to claim 1, wherein the knitted fabric that is obtained at the outlet of the multi-feed knitting machine (1) is accumulated in the treatment chamber (7') by gravity.

5. The method according to claim 1, wherein the method is interrupted by provision of an intermediate storage stage.

6. The method according to claim 5, wherein the knitting machine is a stationary knitting machine, in which the threads are brought individually into rotation above the machine by rotating spools with their support, but the knitted fabric that is produced by the stationary machine is driven to the outlet of the latter by guide cylinders and transported in one or more heat, chemical or other treatment chambers, whereby the knitted fabric is arranged at the outlet of this chamber or these chambers in a pot or on a spool and cut after filling the pot or the spool, and then stored.

7. The method according to claim 6, wherein after the storage, the knitted fabric is taken up in the pot or on the spool for unraveling from the last knit thread, whereby the pot is mounted on a support in a rotary manner around a vertical axis or whereby the spool is mounted on a rotary spool support around an axis that is perpendicular to the axis of the spool, whereby the unraveled threads are then wound or beamed or subjected to another treatment or transformation operation.

8. The thread treatment line for the implementation of the method according to claim 1, comprising:

a multi-feed knitting machine (1) that is supplied with threads (2) by means of spools (3);

an accumulation device prior to unraveling; and an unraveling unit (4) that supplies a winder (5), optionally with an interposed accumulator (6), wherein one or more heat, chemical or other treatment chambers (7, 7') are provided between the knitting machine (1) and the unraveling unit (4), the accumulation device prior to unraveling being provided in the treatment chamber (7, 7').

9. The thread treatment line according to claim 8, wherein it also comprises a device (8) for driving the knitted fabric in rotation and in movement along a longitudinal axis, between the outlet of the knitting machine (1) and the unraveling unit (4).

10. The thread treatment line according to claim 9, wherein the drive device (8) rotates around a longitudinal axis and comes in the form of two pairs of traction cylinders (8'), extending perpendicular to the direction of forward motion and to the longitudinal axis of the knitted fabric that exits from the multi-feed knitting machine (1) and each mounted on a rotary bearing (9) around the longitudinal axis of the knitted fabric, whereby the support bearings (9) of the traction cylinders (8') are synchronized in rotation between one another and with the drum of the multi-feed knitting machine (1).

11. The thread treatment line according to claim 8, wherein the accumulation device comprises superposed meshed belts for accommodating and driving the knitted fabric at a linear speed that is variable but at most equal to the linear knitting speed, whereby these belts are mounted on a common chassis that is driven in rotation around a longitudinal axis, in sync with a drive device (8) and arranged between traction cylinders (8') of the drive device (8), in the treatment chamber (7, 7').

12. The thread treatment line according to claim 8, wherein the accumulation device is an accumulation device with return rollers that are arranged between traction cylinders (8') of the drive device (8) in the treatment chamber (7, 7') and mounted on a chassis that is driven in rotation in sync with the drive device (8).

13. The thread treatment line according to claim 8, wherein the thread treatment line is arranged vertically, and the treatment chamber (7') is vertical and simultaneously forms a means of accumulation by gravity that is supplied by traction cylinder (8') of a drive device (8), whereby the unraveling unit (4) is directly connected to the lower part of the treatment chamber (7').

14. The thread treatment line according to claim 8, wherein the unraveling unit (4) comprises a comb or a plate with holes (11) for individually guiding the threads and a thread pulling means (12).

15. The thread treatment line according to claim 14, wherein the unraveling unit (4) has a means (12) for pulling threads comprising a plurality of pairs of individual drive rollers (12') for each thread (2), whereby each pair of rollers (12') is regulated individually by means of an optical, mechanical or other detection device (13) that monitors any tension variation of the threads (2).

16. The thread treatment line according to claim 8, wherein the unraveling unit (4) consists of a means (14) for pulling and shaping the knitted fabric along a approximate initial section and by individual unraveling eyelets (15) that are arranged upstream from the thread pulling means (12).

17. The thread treatment line according to claim 16, wherein the means (14) for pulling and reshaping the knitted fabric along the approximate initial section consists of an even number of trainers (14') in the form of conical screws, arranged in the shape of a truncated cone on a rotary support (14") and half driven by a differential drive (16).

18. The thread treatment line according to claim 17, wherein the conical screws that form the trainers (14') have a smooth lower zone, close to the rotary support (14"), and are alternately equipped with right-handed threading and left-handed threading, whereby two screws with opposite threads are connected to one another by a pair of drive gears (17), and one of the screws forms a trainer (14') with a pair of trainers (14') being in a drive connection with a drive gear (18) of differential drive (16), by means of a drive gear (19).

19. The thread treatment line according to claim 16, wherein the means (14) for pulling and reshaping the knitted fabric along the approximate initial section is driven in rotation at the speed of rotation of the knitting, in sync with the multi-feed knitting machine (1), by means of a drive gear that is integral in rotation with a rotary support (14"), and trainers (14') in the form of conical screws engage with the drive gear (18) of the differential drive (16).

20. The thread treatment line according to claim 16, wherein the means (14) for pulling and reshaping the knitted fabric along the approximate initial section is equipped with at least one position sensor of the end of the knitted fabric during unraveling, as well as unraveling position sensors, which are connected, respectively, to an electronic control means of the differential drive (16) and to the thread pulling means (12).

21. The thread treatment line according to claim 20, wherein the position sensors comprise detection-by-zone sensors, to detect the end of the knitted fabric to be unraveled or a thread during unraveling, by verification of a positioning at a predetermined location of the zone, and they deliver signals for acceleration or deceleration of the speed of rotation of the differential drive (16) and/or of the pairs of individual drive rollers (12') for each thread (2) by thread pulling means (12).

* * * * *